US005225307A

United States Patent [19]

Hor et al.

[11] Patent Number: 5,225,307

[45] Date of Patent: Jul. 6, 1993

[54] PROCESSES FOR THE PREPARATION OF PHOTOGENERATING COMPOSITIONS

[75] Inventors: Ah-Mee Hor, Mississauga; Rafik O. Loutfy, Willowdale; George Liebermann, Mississauga, all of Canada; Donald J. Teney, Rochester, N.Y.

[73] Assignee: Xerox Corporation, Stamford, Conn.

[21] Appl. No.: 829,150

[22] Filed: Jan. 31, 1992

[51] Int. Cl.[5] ..... G03G 5/06

[52] U.S. Cl. ..... 430/136; 430/128; 430/135

[58] Field of Search ..... 430/128, 135, 136

[56] References Cited

U.S. PATENT DOCUMENTS

| | | | |
|---|---|---|---|
| 3,904,407 | 9/1975 | Regensburger et al. | 430/58 |
| 3,972,717 | 8/1976 | Wiedemann | 430/58 |
| 4,426,434 | 1/1984 | Arishima et al. | 430/128 |
| 4,431,722 | 2/1984 | Takei et al. | 430/57 |
| 4,668,600 | 5/1987 | Lingnau | 430/83 |
| 4,925,760 | 5/1990 | Baranyi et al. | 430/59 |
| 4,948,216 | 8/1990 | Brazas et al. | 430/128 X |
| 4,952,471 | 8/1990 | Baranyi et al. | 430/59 |
| 4,952,472 | 8/1990 | Baranyi et al. | 430/59 |
| 5,002,734 | 3/1991 | Kowalczyk et al. | 430/128 X |

*Primary Examiner*—Roland Martin
*Attorney, Agent, or Firm*—E. O. Palazzo

[57] ABSTRACT

A process for the preparation of photogenerating pigments which comprises the sublimation of a pelletized crude photogenerating pigment at a temperature of from about 250° to about 500° C.; depositing the sublimate onto a substrate; subsequently increasing the sublimation temperature by from about 10° to about 100° C. above the first sublimation temperature, and depositing the resulting sublimate onto a substrate.

21 Claims, 1 Drawing Sheet

PROCESSES FOR THE PREPARATION OF PHOTOGENERATING COMPOSITIONS

BACKGROUND OF THE INVENTION

This invention is generally directed to processes for the preparation of photogenerating compositions, and more specifically, the present invention is directed to processes for the sublimation preparation and purification of photogenerating pigments, such as benzimidazole perylene in high purity, for example from about 95 to about 99.9 percent pure, and with excellent, or improved photoelectrical characteristics, such as low dark decay, and acceptable photosensitivity by utilizing pelletized crude starting components. In one embodiment of the present invention, there are provided economical processes for the preparation of high purity photogenerating pigments by a fractionation sublimation method which involves the stepwise sublimation of a pelletized crude pigment, such as benzimidazole perylene from an evaporation source crucible. The fractionation sublimation may comprise two or more sublimation processes. In one embodiment of a two-step fractionation sublimation, the sublimation temperature in the initial step is slightly above, for example from about 300° to about 550° C., and more specifically, for benzimidazole perylene and for phthalocyanines it is about 500° to about 530° C., and for dibromoanthanthrone it is from about 300° to about 350° C., the subliming temperature of the pigment such that an effective amount, for example, from between about 5 to about 20 weight percent of the sublimate is deposited by the condensation of the vapor of the sublimed material onto a collector substrate, or sheet of, for example, glass, quartz, metals such as stainless steel, and aluminum. Subsequently, the sublimation temperature in the second step is increased by 10° to 100° C. for an effective period of time, for example from about 1 hour to 3 hours for each kilogram of crude pigment, for example, until from between about 50 to about 80 weight percent of the resulting high photoelectrical sublimate photogenerating pigment is collected on a second substrate. Optionally, the fractionation sublimation processes of the present invention may include multisublimation steps, that is, for example, more than two and up to 10 in embodiments. The use of pelletized crude rather than the powder assynthesized crude can provide improvement in the purity and electrical properties of the final sublimates. Sublimable photogenerating pigments, such as phthalocyanines, perinones, perylenes, polycyclic aromatic coumpounds, pyrrolopyrroles, polycyclic quinones, cyanines and the like, can be prepared by the processes as illustrated herein in embodiments. In particular, the conditions for purifying benzimidazole perylene in the twostep sublimation are chosen such that the temperature range in the first step is controlled at between 500° to about 530° C. and the temperature range in the second step is maintained between 540° to 600° C.

The electrical performance of photoresponsive members used in electrophotographic applications can depend on the purity of the photogenerating pigments. Generally, the photosensitivity, cyclic stability, and charging properties of photoresponsive members can be severely degraded by the presence of certain impurities in the photogenerating pigments. Unfortunately, many of the known photogenerating pigments are not easily purified by chemical methods because, for example, of their extremely poor solubilities in organic solvents. For example, the prior art discloses the selection of strong acids and strong bases in an attempt to dissolve these pigments for purification purposes. However, detrimental byproducts and additional impurities are produced in these chemical methods causing significant degradation in electrical properties of the final photogenerating pigment materials. Filtration of fine pigment particles which are reprecipitated from the acid or base solutions in the aforementioned purification process is usually a time-consuming process extending over about two weeks in embodiments. Furthermore, the chemical methods can generate large quantities of waste, for example when 1,152 killigrams of sulfuric acid, ammonium hydroxide and solvents such as dimethylformamide are used in purifying 3.5 killigrams of VOPc by acid pasting method, reference U.S. Pat. No. 4,771,133, the weight ratio of waste chemicals to pigment is high, that is about 300 times quantities of waste materials such as acids, bases, byproducts from the acid pasting purification method have to be properly disposed of to minimize environmental pollution. Risks of causing poor pigment quality, waste chemical disposal, and additional costs encountered in the prior art chemical purification approach are serious disadvantages that are avoided or eliminated with the processes of the present invention.

Photoresponsive members provided with a photogenerating layer comprised of a vacuum deposition of organic pigment are disclosed in U.S. Pat. Nos. 4,587,189; 4,578,334 and 4,555,463. The preparation of the generator layer requires large vacuum coating equipment wherein it is difficult to control the uniformity in thickness of thin generator layer over extended area and length of the conductive substrate. Moreover, to form a complete photoresponsive member, the generating layer is to be overcoated with charge transport layer by a different coating technique, namely, solution coating. As a result, two separate coating facilities and processes are involved which can significantly increase the cost of production. In practice, a single coating technique will be more desirable from an economic and manufacturing standpoint.

The present invention involves in embodiments purifying sublimable organic photogenerating pigments by a fractionation sublimation process and incorporating the resulting sublimed pigment into photoresponsive members. The preparation of photoresponsive members is preferably accomplished by solution coating of both photogenerating and transport layers. The solution coating may be dip, spray, slot, or web coating methods. The sublimation process may also lends itself as a means to purify a crude pigment which can then be used in the vacuum coating of a thin photogenerating layer. The vacuum coated photogenerating layer would have significantly reduced coating defects since the sublimation of pigment in accordance with the processes of the present invention prior to the vacuum coating can remove some volatile impurities which would have been otherwise been incorporated into the photogenerating layer.

Certain sublimation process such as train sublimation are illustrated in U.S. Pat. Nos. 4,952,471 and 4,952,472 and by H. J. Wagner in *J. Materials Science*, 17, 2781 (1982). The train sublimation process involves passing a carrier gas over a crude material in a glass tube situated in a specially designed oven which had a temperature gradient. By adjusting the flow of gas and controlling the temperature profile of the oven, it is possible to effect the sublimation of pigment to form vapor at the high temperature zone, which vapor was then carried to downstream and condensed to form solid deposits at the lower temperature zones. The desired sublimed pigment was deposited at the medium temperature zone and the more volatile impurities at the low temperature zone. A separation of impurities from the sublimed pigment was hence achieved. The train sublimation process was generally not efficient as desired as the presence of carrier gas (pressure between 1 and 10 Torr) greatly decreased, for example by a factor of ten, the sublimation rate of material and hence prolonged the duration of sublimation. The conventional operation spanned over 12 hours for even a small amount, about 10 grams, of starting material used in the sublimation. In addition, the furnace had to be sufficiently long and its temperature profile properly controlled in order to achieve a good spatial separation of purified sublimed material from the crude and more volatile impurities. These requirements can impose great complexities in the design of large production equipment and cause complex costly operations. The train sublimation, though useful in obtaining small amounts of purified materials, is not believed to be economically convertable to large scale productions.

Also, there is disclosed in U.S. Pat. No. 4,431,722 a vacuum sublimation process for a class of polycyclic quinone pigments such as anthanthrone, dibenzpyrenequinone, and pyranthrone derivatives. These pigments have low subliming temperatures of 350° C. This patent does not disclose removing volatile impurities which could contaminate the final sublimed pigment. Volatile impurities could be present in the crude material or produced as decomposition products during the initial heating of the crude material. For other pigments having a higher subliming temperature greater than 450° C., such as perylenes, and phthalocyanines, the higher temperature heating in the initial stage of sublimation can cause the formation of significantly large amount of volatile decomposition impurities. As a result, these volatile impurities cannot be separated from the deposited sublimed material and the benefits of sublimation process were not fully realized. The shortcomings of the process of the '722 patent were reflected in the results of simple sublimation of various pigments which were summarized in Table 1 of this patent. The observed changes in electrical properties shown in Table 1 amounted to some improvement, about 25 percent, in photosensitivities as indicated by the reduction in $E_{\frac{1}{2}}$ values. However, worsening in the charging property as seen in the decreasing $V_o$ occured for all pigments attempted in the sublimation trials. The decrease reached up to 139 volts in one case which suggests a severe contamination of sublimed pigment by impurities occuring in the simple sublimation process. Also, this process failed to recognize the need of preventing the ejection of crude materials, especially those in the form of light and fluffy powder, from the crucible onto the sublimed material which would become contaminated.

With the fractionation sublimation process of the present invention there can be enabled in embodiments, for example, the separation of volatile component, impurities such as residual (unreacted) phthalonitrile in the crude phthalocyanines, residual perylene tetracarboxylic dianhydride in the crude perylene pigments, into the first fraction of sublimate and these impurities will not then cause contamination into the second or subsequent fractions of the sublimate. The aforementioned volatile impurities can be those originally present in the crude material or produced during initial heating of crude material. Also, the use of a pelletized crude material eliminates contamination problems posed by prior art fluffy powder crude materials. Pellets are capable of holding the powder together during handling and sublimation, whereas fluffy powder crude as well as residual ashes formed tend to eject from the evaporation crucible during sublimation and become incorporated into the sublimate. The impurities from crude powder and residual ashes are detrimental to the electrical properties of sublimate collected. In the '722 patent no fractionation is involved, and the separation of volatile impurities from the final sublimate is not accomplished, thus volatile impurities are incorporated into the sublimed product material.

Although the sublimation processes for purifying organic pigments have been described in the prior art, there remains a need for developing a sublimation process which is more capable of producing highly purified sublimed materials in a cost effective and controllable manner, and yet does not have many of the aforementioned shortcomings. The invention of the present application is directed to an improved fractionation sublimation process wherein, for example, high purity organic photogenerating pigment suitable for electrophotographic imaging applications can be obtained. The process, for example, involves fractionation sublimations using a pelletized crude starting material. In particular, the process of the present invention in embodiments can remove unreacted perylene tetracarboxylic dianhydride in the perylene crude and phthalonitrile in the phthalocyanine crude, volatile impurities from contaminating the sublimed materials. The volatile impurities may be those already present as byproducts in the crude material which are formed during the chemical synthesis of pigment. They could also be produced as decomposition byproducts during the initial heating process of sublimation. Therefore, the fractionation process of the present invention can allow for the control of the quality of the sublimed materials by separating these volatile impurities from the desired fractions. Moreover, the process of the present invention involves the use of pelletized crude pigment in a sublimation method which virtually eliminates the direct contamination of final sublimed product by the crude material. During sublimation, the pelletized crude material can hold the powder in compact form and prevent the ejection of crude material from the crucible onto the collector where it can be incorporated into the sublimed material. However, the uncompressed, light and fluffy crude powder can be easily projected onto the collector, especially at high sublimation rate. Furthermore, the powder of photogenerating pigments is usually insulating in nature and have a tendency to undergo triboelectric charging due to friction and form a floating cloud during handling. These floating particles of crude material can rise to deposit onto the sublimed material collected in the sublimation equipment, and a severe contamination of the sublimed pigment by impurities can greatly degrade the photoresponsive performance of the final product. Thus, the powder crude selected for the processes of the present invention can be compressed into compact pellets which avoid the disadvantages associated with light and fluffy components, which are not free floating clouds.

Purified, sublimed organic pigments prepared by this invention are useful for the preparation of electrophotographic imaging members which exhibit improved electrical properties such as high charge acceptance, stable charging and high photosensitivity. The imaging members generally comprise a photosensitive layer composed of a pigment-containing layer prepared either by solution coating a dispersion of sublimed material in polymeric slurry or solvent, or by vacuum coating of solid sublimed material. In one device configuration, the imaging members contain separate photogeneration and transport layers coated on suitable conductive substrate. In another device configuration, the photogeneration and charge transport functions occur within a single composite layer. Examples of both types of device configurations are described in U.S. Pat. Nos. 4,265,990; 4,514,482; 4,937,164, and related patents, the disclosures of which are totally incorporated herein by reference.

Documents illustrating organic electrophotographic photoconductor elements with azo, bisazo, and related compounds include U.S. Pat. Nos. 4,390,611, 4,551,404, 4,596,754, Japanese Patent 60-64354, U.S. Pat. Nos. 4,400,455, 4,390,608, 4,327,168, 4,299,896, 4,314,015, 4,486,522, 4,486,519, 4,555,667, 4,440,845, 4,486,800, 4,309,611, 4,418,133, 4,293,628, 4,427,753, 4,495,264, 4,359,513, 3,898,084, 4,830,944, 4,820,602, and Japanese Patent Publication 60-111247.

SUMMARY OF THE INVENTION

It is a feature of the present invention to provide processes for the preparation of photogenerating pigments with many of the advantages mentioned herein in embodiments thereof.

Another feature of the present invention is to provide processes for the preparation of high purity photogenerating pigments, and imaging members thereof, which members can be sensitive to wavelengths of from about 400 to about 850 nanometers.

In another feature of the present invention there are provided improved processes for preparing photogenerating pigment by fractionation sublimation from the pellets of crude pigment.

Another feature of the present invention resides in the provision of photoresponsive imaging members which can possess excellent dark decay properties, high charge acceptance values, high photosensitivity values, and electrical stability.

Further, in another feature of the present invention there are provided photoconductive imaging members that can be simultaneously responsive to infrared light, and to visible light.

Additionally, another feature of the present invention resides in the provision of imaging and printing methods with the photoconductive imaging members illustrated herein.

These and other features of the present invention in embodiments thereof can be accomplished by the provision of processes for the preparation of photogenerating pigments, such as perylenes, phthalocyanines, perinones, polycyclic aromatic compounds, pyrrolopyrroles, polycyclic quinones and the like. More specifically, in embodiments benzimidazole perylenes, reference U.S. Pat. No. 4,587,189, the disclosure of which is totally incorporated herein by reference, chloroindium phthalocyanine, titanyl phthalocyanine, and other known photogenerating pigments obtained with the processes of the present invention can be selected for layered photoconductive imaging members. Specifically, the present invention is directed to processes for the preparation of photogenerating pigments which comprises the fractionation sublimation of pelletized crude materials at different temperatures in vacuum and collecting different fractions of sublimed materials in each sublimation step. The initial fraction obtained by evaporating the pellets at low temperature normally accounts for a small portion, less than 20 percent by weight, of sublimed material. The subsequent sublimation steps accomplished in one or more sublimation steps at higher temperature generate a larger amount, about from 50 to about 80 weight percent, of sublimed materials.

In embodiments, the fractionation sublimation of benzimidazole perylene is accomplished in the following manner. The crude benzimidazole perylene, that is, for example, cis and trans isomers of benzimidazole perylene, and more specifically the cis isomer bisbenzimidazo(2,1-a:1',2'-b')anthra(2,1,9-def:6,5,10-d'e'f'-)diisoquinoline-6,11-dione and the trans isomer bisbenzimidazo(2,1-a:2',1'-a')anthra(2,1,9-def:6,5,10-d'e'f'-)diisoquinoline-10,21-dione, usually 50 weight percent cis, and 50 weight percent trans, can be selected as a reactant for the processes of the present invention, and wherein there results cis and trans isomers of benzimidazole perylene with improved properties.

In an embodiment, the aforementioned cis, trans benzimidazole perylene can be prepared by a known chemical synthesis, reference for example U.S. Pat. No. 4,587,189, see Example I, the disclosure of which is totally incorporated herein by reference. The powder of crude benzimidazole perylene material is compressed into cylindrical pellets 13 millimeters in diameter and 2 to 10 millimeters in height by using a commercial Stokes pelletizer operated at a pressure of one ton. The pellets of perylene are then electrically heated about 500° C. in an evaporation crucible situated in a vacuum chamber which has been evacuated to a pressure less than $10^{-3}$ Torr, preferably between $10^{-4}$ and $10^{-5}$ Torr. Above the crucible there is a collector substrate. The collector substrate can be glass, quartz, stainless steel and is usually in a semicylindrical form. It is positioned about 4 to 20 inches directly above the crucible in a manner that it will effectively capture the subliming perylene vapor during sublimation. The temperature of the crucible is maintained between 500° and 530° C. for an effective period of time, for 600 grams to 750 grams of pellets the time can be between 5 to 20 minutes, such that the crude has evaporated and about 5 to 15 weight percent of sublimed material is deposited onto the substrate. After allowing the crucible to cool down to less than 200° C., and admitting air into the vacuum chamber, the collector substrate is removed. A second piece of collector substrate is then installed in place of the first one and the chamber is evacuated as before. The crucible temperature is further raised and retained at between 540° to 600° C. for a longer period of time than the aforementioned first sublimation, for example from about 60 to about 120 minutes, such that 50 to 80 weight percent of sublimed material is deposited onto the second collector. Optionally, the fractionation sublimation can be carried out in three or more steps by modifying the temperature and duration of sublimation in each sublimation step in order to obtain the required amount and properties of each fraction of sublimed material. Further sublimation steps can also be accomplished, for example 3 to 5 sublimations, to perhaps further improve the purity of the resulting product in embodiments of the present invention.

The sublimed perylene product, and more specifically, the cis isomer bisbenzimidazo(2,1-a:1',2'-b')anthra(2,1,9-def:6,5,10-d'e'f')diisoquinoline-6,11-dione and the trans isomer bisbenzimidazo(2,1-a:2',1'-a')anthra(2,1,9-def:6,5,10-d'e'f')diisoquinoline-10,21-dione are subjected to multi-elemental analysis by direct current plasma emission spectrophotometry and the results indicate a substantial decrease, for example by greater than 50 percent, in the amount of undesirable metallic impurities in comparison to the crude material. The iron, calcium, copper, aluminum and sodium impurity contents of the crude material are, for example, 340, 210, 170, 110, and 710 ppm, respectively, whereas for the sublimed perylene product prepared from the pelletized perylene, these values are less than 30, 30, 10, 15, and 300 ppm as measured in each instance by the known plasma method. The sublimed perylene obtained from the powder crude material possess impurity contents between the above two extremes, for example iron 30 to 340 ppm, calcium 30 to 210 ppm, copper 10 to 170 ppm, aluminum 15 to 110 ppm, and sodium 300 to 710 ppm, indicating that partial contamination occured during sublimation of the powder material. The range of impurity content of sublimed perylene prepared from the powder crude material is iron 90 to 190, calcium 70 to 100, copper 50 to 87, aluminum 1 to 24, and sodium 440 to 460. The use of pelletized crude eliminates the contamination issue by preventing the light and fluffy crude powder from ejecting onto the collector substrate and becoming incorporated into the sublimed material during sublimation. The improvements in xerographic electrical properties of sublimed materials obtained from pelletized crude as compared to either the crude or the sublimed material obtained from powder crude, which are described in Example IV, further establishes the superior capability of sublimation process of this invention in refining the benzimidazole perylene pigment.

The fractionation sublimation procedure described above for benzimidazole perylene can be modified by, for example, selecting the appropriate initial and second sublimation temperatures for each pigment material, the range of temperatures depend on subliming temperature of each pigment, the initial sublimation temperature for fractionating the high volatile impurities can be selected at 300° to 350° C. instead of 500° to 530° C., and the like, to achieve the purification of various sublimable pigments, such as other perylenes, phthalocyanines, perinoes, polycyclic quinones, pyrrolopyrroles, polycyclic aromatic compounds, cyanines, and the like. The process of this invention is particularly useful for sublimation purification of pigments whenever there are volatile impurities present in the as-synthesized crude pigment and/or the initial heating of assynthesized pigment generates decomposition impurities.

Embodiments of the present invention include a process for the preparation of photogenerating pigments which comprises the sublimation of a pelletized crude photogenerating pigment at a temperature of from about 250° to about 500° C.; depositing the sublimate onto a substrate; subsequently increasing the sublimation temperature by from about 10° to about 100° C. above the first sublimation temperature, and depositing the resulting sublimate onto a substrate; a process for the preparation of photogenerating pigments which comprises the sublimation of a pelletized crude photogenerating pigment at a temperature of from about 250° to about 500° C.; depositing the sublimate onto a first substrate; subsequently increasing the sublimation temperature by from about 10° to about 100° C. above the first sublimation temperature, and depositing the resulting sublimate onto a second substrate; allowing each substrate to cool; and removing the deposited photogenerating pigment; a process for the preparation of photogenerating pigments with improved photoelectrical characteristics which comprises the fractional stepwise sublimation of a pelletized crude photogenerating pigment, and wherein the initial sublimation temperature is from about 250° to about 500° C.; depositing from about 0.1 to about 20 weight percent of the sublimate onto a substrate; subsequently increasing the sublimation temperature by from about 10° to about 100° C. above the first initial sublimation temperature for an effective period of time to enable from between about 50 to about 80 weight percent of the sublimate photogenerating pigment to be collected on a second second substrate; cooling each substrate; and removing the deposited photogenerating pigment.

The photogenerating compounds obtained with the processes of the present invention can be incorporated into various photoconductive imaging members. One such member is comprised of a supporting substrate, a charge transport and the photogenerating pigments obtained with the process as illustrated herein with respect to the present invention. In one specific illustrative embodiment, the photoresponsive member can be comprised of (1) a supporting substrate, (2) a hole blocking layer, (3) an optional adhesive interface layer, (4) a photogenerating layer comprised of the purified pigments obtained with the processes of the present invention, and (5) a hole transport layer. Thus, a specific photoresponsive member of the present invention can be comprised of a conductive supporting substrate, a hole blocking metal oxide layer in contact therewith, an adhesive layer, the photogenerating pigment overcoated on the optional adhesive layer, and as a top layer a hole transport layer comprised of certain diamines dispersed in a resinous matrix. The photoconductive layer composition when in contact with the hole transport layer is capable of allowing holes generated by the photogenerating layer to be transported. Examples of aryl amine hole transport molecules that may be selected for the photoconductor devices are illustrated in U.S. Pat. No. 4,265,990, the disclosure of which is totally incorporated herein by reference. Also, examples of charge transport molecules are illustrated in U.S. Pat. No. 4,921,773, and the patents mentioned therein, the disclosures of each of the aforementioned patents, including the '773 patent, being totally incorporated herein by reference. Another form of imaging member is comprised of a single photoactive composite layer capable of performing both photogeneration and charge transport functions in a single layer instead of two separate layers as mentioned in U.S. Pat. No. 4,937,167.

The photoresponsive devices described herein can be incorporated into various imaging systems such as those conventionally known as electrophotographic imaging processes. Additionally, the imaging members of the present invention can be selected for imaging and printing systems with visible light and/or infrared light. In this embodiment, the photoresponsive devices may be negatively or positively charged, exposed to light in a wavelength of from about 400 to about 850, and preferably from about 400 to about 800 nanometers, either sequentially or simultaneously, followed by developing the resulting image and transferring to paper.

BRIEF DESCRIPTION OF THE FIGURES

For a better understanding of the features of the present invention, the following detailed description of various embodiments is provided wherein.

DESCRIPTION OF SPECIFIC EMBODIMENTS

Specific embodiments of the invention will now be illustrated, it being noted that substantially equivalent imaging members are also embraced within the scope of the present invention.

Figure 1:
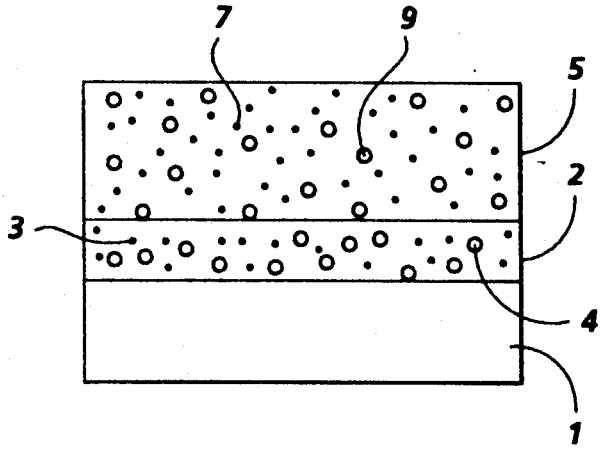
FIGS. 1 and 2 are partially schematic views of examples of photoresponsive imaging members of the present invention containing separate photogeneration and charge transport layers.

FIG. 1 illustrates a photoresponsive imaging member comprising a supporting substrate 1, a photogenerating layer 2 comprising the benzimidazole perylene 3 obtained by the sublimation processes of the present invention optionally dispersed in a resinous binder composition 4, and a charge carrier transport layer 5, which comprises hole transporting molecules 7 dispersed in an inactive resinous binder composition 9.

Figure 2:
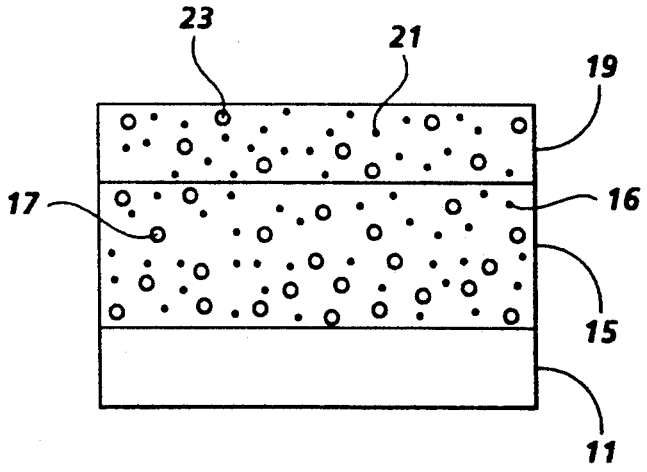

FIG. 2 illustrates a similar imaging member as that illustrated in FIG. 1 with the exception that the charge transport layer is situated between the supporting substrate and the photogenerating layer. More specifically, this figure illustrates a photoresponsive imaging member comprising a supporting substrate 11, a hole transport layer 15 comprising aryl amine hole transport molecules 16 dispersed in an inactive resinous binder composition 17, and a photogenerating layer 19 comprising benzimidazole perylene, chloroindinium phthalocyanine 21 obtained by the processes disclosed herein, optionally dispersed in a resinous binder composition 23.

The photoconductive imaging member may also contain the photogeneration and charge transport functions in a single composite layer. This composite layer can be comprised of benzimidazole perylene obtained by the process disclosed herein, aryl amine charge transport molecules, and electron transport molecules, dispersed in resinous binder composition. Also, the photogenerating pigments obtained with the processes of the present invention can be selected for single layered imaging members where a separate charge transporting layer is not present.

The photoresponsive imaging members containing sublimed pigments obtained in accordance with the present invention exhibit improved charging properties such as low dark decay (<20 volts/second) and high charge acceptance (800 volts or higher), high photosensitivity (with half-discharge exposure energy $E_{\frac{1}{2}}<5$ erg/cm$^2$), and long life (10 thousands or more cycles). These are important for xerographic imaging applications. The improved charging enables stable and reproducible functioning of imaging members which are essential for producing multiple copies of the required image without distortion. Long life as manifested in stable performance over extended periods of operation will reduce the down time of the imaging machine and require less frequent replacement of imaging members. High photosensitivity enables the imaging members to be operated in a more efficient manner requiring less light exposure energy in the imaging process. Furthermore, the sublimation produces purified photogenerating materials with consistent electrical and imaging properties hence reduces the batch-to-batch variation in performance of final imaging members prepared from different batches of sublimed pigment. On the other hand, imaging members containing the crude pigment cannot afford all the advantages described above. The crude material contains various detrimental impurities which severely degrade the xerographic performance of the imaging members.

The supporting substrate of the imaging members may comprise an insulating material such as an inorganic or organic polymeric material, including MYLAR®, a commercially available polymer; a layer of an organic or inorganic material having a semiconductive surface layer such as indium tin oxide or aluminum arranged thereon; or a conductive material such as aluminum, titanium, chromium, nickel, brass, or the like. The substrate may be flexible, seamless, or rigid and may have a number of different configurations, such as a plate, a cylindrical drum, a scroll, an endless flexible belt, and the like. In one embodiment, the substrate is in the form of an endless flexible belt. In some situations, it may be desirable to coat an anticurl layer, such as polycarbonate materials commercially available as MAKROLON®, on the back of the substrate, particularly when the substrate is an organic polymeric material.

The thickness of the substrate layer depends on a number of factors, including economic considerations, the components of the other layers, and the like. Thus, this layer may be of substantial thickness, for example up to 125 mils, or of minimal thickness provided that there are no adverse effects on the system. In embodiments, the thickness of this layer is from about 3 mils to about 20 mils.

Generally, the photogenerating layer has a thickness of from about 0.05 micron to about 10 microns or more, and preferably has a thickness of from about 0.1 micron to about 4 microns. The thickness of this layer, however, is dependent primarily upon the photogenerating weight loading, which may vary from about 5 to 100 percent, the components of the other layers, and the like. Generally, it is desirable to provide this layer in a thickness sufficient to absorb a substantial amount, for example from about 80 to about 90 percent or more, of the incident radiation which is directed upon it in the imagewise or printing exposure step. The maximum thickness of this layer is dependent primarily upon factors such as mechanical considerations, such as the specific perylene pigment selected, the thicknesses of the other layers, and whether a flexible photoconductive imaging member is desired. Examples of binder material for the photogenerating layer are poly(vinyl acetals), polycarbonates, polyesters, polyvinyl carbazole, polyvinyl butyral, and the like. Typical effective amounts of binder can be selected including, for example, from about 5 to about 95 weight percent, and preferably from about 10 to about 70 percent, in embodiments of the present invention. The photogenerating layer can be prepared by solution coating of a pigment slurry in solvent, or a pigment dispersion in resinous binder solution. Various known techniques such as spray, dip, slot and web coating methods are applicable. The photogenerating layer may also be prepared by vacuum coating method as the pigments obtained in this invention are sublimable.

The charge transport layer can be comprised of various known components providing, for example, that they effectively transport charges (holes) such as an aryl amine compound dispersed in a resinous binder and other components, reference the '773 patent mentioned herein, the disclosure of which is totally incorporated herein by reference. In one embodiment, the hole transport layers are comprised of aryl amine compounds of the formula:

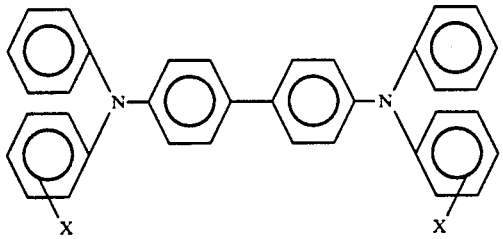

wherein X is selected from the group consisting of alkyl and halogen. Preferably, X is selected from the group consisting of methyl and chloride in either the ortho, meta, or para positions. Suitable inactive binder materials for the hole transport layer include known highly insulating resins, which generally have a resistivity of at least $10^{12}$ ohm-cm to prevent undue dark decay. Compounds corresponding to the above formula include N,N'-diphenyl-N,N'-bis(alkylphenyl)-[1,1'-biphenyl]-4,4'-diamine, wherein alkyl is selected from the group consisting of methyl, such as 2-methyl, 3-methyl and 4-methyl, ethyl, propyl, butyl, hexyl, and the like. With halo substitution, the amine is N,N'-diphenyl-N,N'-bis(-halo phenyl)-[1,1'-biphenyl]-4,4'-diamine, wherein halo is 2-chloro, 3-chloro or 4-chloro. Other electrically active small molecules that can be dispersed in the electrically inactive resin to form a layer which will transport holes include bis(4-diethylamino-2-methylphenyl)-phenyl methane, 4',4''-bis(diethylamino)-2',2''-dimethyltriphenyl methane, bis-4-(diethylaminophenyl)phenyl methane, and 4,4'-bis(diethylamino)-2,2'-dimethyltriphenyl methane. Generally, the hole transport layer has a thickness of from about 5 to about 75 microns, and preferably of from about 10 to about 40 microns.

Electron Transport molecules such as dicyanofluorenones in U.S. Pat. Nos. 4,474,865 and 4,546,059 (Beng S. Ong), quinones (Y. Yamaguchiet et al., *J Appl. Phys.*, vol. 70, pages 3726 to 3729, 1991) are also useful for the photoresponsive members described in FIG. 2. The member in FIG. 2 is suitable for positively charging applications in which the electrons are injected from the photogenerating layer and migrate across the transport layer. For a composite member, both positive and negative charging methods can be applied. The presence of both hole and electron transport molecules permit the migration of both electron and hole charge carriers across the transport layer.

Examples of highly insulating and transparent resinous components or inactive binder resinous material for the transport layer include materials, such as those described in U.S. Pat. No. 3,121,006, the disclosure of which is totally incorporated herein by reference. Specific examples of suitable organic resinous materials include polycarbonates, arcylate polymers, vinyl polymers, cellulose polymers, polyesters, polysiloxanes, polyamides, polyurethanes and epoxies as well as block, random or alternating copolymers thereof. Preferred electrically inactive binder materials are polycarbonate resins having a molecular weight of from about 20,000 to about 100,000 with a molecular weight in the range of from about 50,000 to about 100,000 being particularly preferred. The materials preferred as electrically inactive resinous materials in embodiments of the present invention are poly(4,4'-dipropylidinediphenylene carbonate) with a weight average molecular weight of from about 35,000 to about 40,000 available as LEXAN TM 145 from General Electric Company; poly(4,4'-isopropylidine-diphenylene carbonate) with a weight average molecular weight of from about 40,000 to about 45,000 available as LEXAN 141 TM from General Electric Company; a polycarbonate resin having a weight average molecular weight of from about 50,000 to about 100,000 available as MAKROLON ® from Farbenfabricken Bayer AG; and a polycarbonate having a weight average molecular weight of from about 20,000 to about 50,000 available as MERLON ® from Mobay Chemical Company. Generally, the resinous binder contains from about 10 to about 75 percent by weight of the active material corresponding to the foregoing formula, and preferably from about 35 percent to about 50 percent of this material.

The photoconductive imaging member may optionally contain a hole blocking layer situated between the supporting substrate and the photogenerating layer. This layer may comprise metal oxides, such as aluminum oxide and the like, or materials such as silanes. The primary purpose of this layer is to prevent hole injection from the substrate during and after charging. Typically, this layer is of a thickness of about 5 to about 300 Angstroms, although it may be as thick as 2,000 Angstroms in some instances.

In addition, the photoconductive imaging member may also optionally contain an adhesive interface layer situated between the hole blocking layer and the photogenerating layer. This layer may comprise a polymeric material such as polyester, polyvinyl butyral, polyvinyl pyrrolidone and the like. Typically, this layer is, for example, of a thickness of less than about 0.6 micron with a thickness range of from about 0.05 to about 1 micron being suitable in embodiments of the present invention.

The present invention also relates to a method of generating images with the photoconductive imaging members disclosed herein. The method comprises the steps of generating an electrostatic image on a photoconductive imaging member of the present invention, subsequently developing the electrostatic image with known developer compositions comprised of resin particles, pigment particles, additives, including charge control agents and carrier particles, reference U.S. Pat. Nos. 4,558,108; 4,560,535; 3,590,000; 4,264,672; 3,900,588 and 3,849,182, the disclosures of each of these patents being totally incorporated herein by reference, transferring the developed electrostatic image to a suitable substrate, and permanently affixing the transferred image to the substrate. Development of the image may be achieved by a number of methods, such as cascade, touchdown, powder cloud, magnetic brush, and the like. Transfer of the developed image to a substrate may be by any method, including those wherein a corotron or a biased roll is selected. The fixing step may be performed by means of any suitable method, such as flash fusing, heat fusing, pressure fusing, vapor fusing, and the like.

The imaging members of the present invention can be prepared by a number of different known processes such as solution coating methods by spray, dip, slot and web coatings or a combination of several coating methods. Those disclosed in the U.S. Pat. No. 4,886,722 are totally incorporated herein by reference. In one process embodiment, the photogenerator is coated onto a supporting substrate with a Bird applicator, for example, followed by the solution coating of the charge transport layer, and thereafter drying in, for example, an oven.

The following examples are being supplied to further define various species of the present invention, it being noted that these Examples are intended to illustrate and not limit the scope of the present invention. Parts and percentages are by weight unless otherwise indicated. A comparative Example and comparative data is also presented.

EXAMPLE I

Preparation of Crude Benzimidazole Perylene 78.7 parts of 1-chloronaphthalene, 4.3 parts of perylene-3,4:9,10-tetracarboxylic dianhydride and 11.9 parts of o-phenylenediamine were charged in a stainless steel reactor equipped with a pitched blade turbine agitator, a circulation jacket connected to an oil supply system, a temperature measuring element and a distillation line with a condenser. After the aforementioned raw materials were charged and the agitator speed adjusted to 200 rpm, the reactor was purged with nitrogen gas and the reactor contents were heated by raising the temperature of the jacket in about one hour to the desired reaction temperature of 240° to 245° C. The reaction was continued for an additional 6 hours at this temperature. The reactor was then cooled by cooling the oil of the jacket with water to about 90° C. and the reactor contents were transferred to a Nutsche vacuum filter equipped with an agitator. The filtrate was drained by applying vacuum to the filter. The crude, wet pigment cake was reslurry washed twice using 80 parts of warm dimethyl formamide with the wash filtrate drained each time by vacuum filtration. The cake was subsequently reslurry washed nine times with alkaline methanol at room temperature in order to remove acidic impurities. Each alkaline methanol wash was made up by dissolving 0.33 parts of sodium hydroxide in 66 parts of methanol. The pigment cake was then reslurry washed four times with methanol (66 parts of methanol used in each wash) and dryed in a vacuum dryer at 65° C. and full vacuum for 16 hours. 5.89 parts of crude benzimidazole perylene powder (Sample I), that is a mixture of the cis, about 50 weight percent, and trans isomers, about 50 weight percent, as indicated herein were obtained. The crude material Sample I was subjected to the known multi-elemental analysis by direct current plasma emission spectrophotometry. The amounts of metallic impurities measured were as follows:

Sample I: Fe: 340 ppm, Ca: 210 ppm, Cu: 170 ppm, Al: 110 ppm, Na: 710 ppm

EXAMPLE II

Sublimation From Crude Benzimidazole Perylene in Pellet Form

The sublimation of benzimidazole perylene was carried out in a vacuum chamber equipped with a stainless steel crucible, about 4 inches in diameter and 20 inches in length, placed below, about 4 inches, a stainless steel collector substrate sheet, about 24 inches long, about 36 inches wide, and about 1/32 inch thick. Crude benzimidazole perylene powder material obtained from the process of Example I was compressed into the cylindrical pellets (4 millimeters in height and 13 millimeters in diameter as measured by a micrometer) by using a Stokes Tablet Press operated at a pressure reading of one ton. About 600 grams of crude perylene pellets was placed into the crucible. After evacuating the chamber to a pressure of about $10^{-4}$ to $10^{-5}$ Torr, an electric current of 400 to 500 amperes was supplied to the crucible, and the temperature of the crucible was raised to about 500° to 530° C. Some of the crude material began to sublime into a vapor which then condensed to deposit onto a collector sheet of stainless steel positioned about 4 inches directly above the crucible. After maintaining the crucible at the said temperature for 10 minutes, the electric current was turned off. When the crucible had cooled down to below 200° C., air was admitted into the vacuum chamber to bring the pressure to atmospheric. The collector substrate was removed from the chamber and about 44 grams of first fraction sublimate (Sample IIA) was collected from the substrate by removal thereof with a scraper blade. A second clean collector comprised of a stainless steel sheet was installed and the chamber was evacuated as before. The crucible was then heated to about 540° C. for about 60 minutes and then further raised to 570° C. for another 130 minutes. After cooling, 408 grams of second fraction sublimate (Sample IIB) deposited onto the collector was obtained by removal thereof with a scraper blade. The yield of the second fraction was 68 percent based on the amount of the starting crude material initially placed in the crucible. The aforementioned fractions were each comprised of the cis isomer bisbenzimidazo(2,1-a:1',2'-b')anthra(2,1,9-def:6,5,10-d'e'f'-)diisoquinoline-6,11-dione and the trans isomer bisbenzimidazo(2,1'-a:2',1'-a')anthra(2,1,9-def:6,5,10-d'e'f'-)diisoquinoline-10,21-dione, 50 weight percent cis, and 50 weight percent trans. Both Samples IIA and IIB were subjected to multi-elemental analysis by direct current plasma emission spectrophotometry. The amounts of metallic impurities measured were as follows:

Sample IIA: Fe: 20 ppm, Ca: 9 ppm, Cu: 1.2 ppm, Al: 13 ppm, Na: 125 ppm

Sample IIB: Fe: 6.5 ppm, Ca: 24 ppm, Cu: 4 ppm, Al: 11 ppm, Na: 290 ppm

The metallic impurity content of sublimed perylene Samples IIA and IIB are lower than those present in the crude material Sample I, indicating the sublimation is at least capable of purifying crude perylene by getting rid of metallic impurities.

COMPARATIVE EXAMPLE III

Sublimation from Crude Benzimidazole Perylene in Powder Form

The sublimation process of Example II was repeated with the exception that the crude perylene selected was in a powder form rather than a pellet form. About 540 grams of as-synthesized material from Example I was loaded into the crucible. The first fraction sublimate (designated Sample IIIA) obtained was 99 grams, and the second fraction sublimate (Sample IIIB) was 375 grams. Both Samples IIIA and IIIB were subjected to multi-elemental analysis by direct current plasma emission spectrophotometry. The amounts of metallic impurities measured were as follows:

Sample IIIA: Fe: 190 ppm, Ca: 98 ppm, Cu: 87 ppm, Al: 24 ppm, Na: 460 ppm

Sample IIIB: Fe: 92 ppm, Ca: 71 ppm, Cu: 50 ppm, Al: 17 ppm, Na: 440 ppm

The metallic impurity content of Samples IIIA and IIIB are substantially higher than those in Samples IIA and IIB indicating more impurity contamination in the former samples. This indicates that the sublimation using powder crude pigment in Example III did not produce as high purity materials like those in Example II wherein the sublimation was performed on pelletized crude pigment.

EXAMPLE IV

Xerographic Evaluation of Benzimidazole Perylene Sublimate Materials

Photoresponsive imaging members were fabricated using perylene sublimate samples (Samples IIA, IIB, IIIA and IIIB) which were prepared in Examples II and III, respectively. The imaging members were comprised of a titanium metallized MYLAR ® substrate of 75 microns in thickness, sequentially overcoated with a thin photogenerating layer of the perylene sublimate, and an aryl amine charge transport layer. The photogenerating layer was prepared by solution coating a perylene dispersion. The perylene dispersion was prepared as follows: 0.40 gram of perylene sublimate sample was mixed with 0.10 gram of polyvinylcarbazole (PVK) polymer in a 30 cc glass bottle containing 70 grams of ⅛ stainless steel balls and 12.2 grams of methylene chloride. The bottle was placed on a roller mill and the dispersion was milled for 5 days. The perylene dispersion was coated onto a titanium metallized MYLAR ® using a film applicator of 1.5 mil gap. Thereafter, the photogenerating layer was dried in a forced-air oven at 135° C. for 20 minutes and the measured thickness was 1 micron. The aryl amine transport layer was prepared as follows: a transport layer solution was made by mixing 8.3 grams MAKROLON ®, a polycarbonate resin, 4.4 grams N,N'-diphenyl-N,N'-bis(3-methylphenyl)(1,1'-biphenyl)-4,4'-diamine and 82.3 grams methylene chloride. The solution was coated onto the above photogenerating layer using a film applicator of 10 mil gap. The resulting member was dried at 135° C. in a forced-air oven for 20 minutes and the final dried thickness of transport layer was 20 microns.

The xerographic electrical properties of each imaging member were then determined by electrostatically charging its surface with a corona discharging device until the surface potential, as measured by a capacitively coupled probe attached to an electrometer, attained an initial value $V_o$. After resting for 0.5 second in the dark, the charged member reached a surface potential of $V_{ddp}$, dark development potential, and was then exposed to light from a filtered xenon lamp. A reduction in the surface potential to $V_{bg}$, background potential, due to photodischarge effect was observed. The dark decay in volt/second was calculated as $(V_o-V_{ddp})/0.5$. The lower the dark decay value, the better is the ability of the member to retain its charge prior to exposure by light. Similarly, the lower the $V_{ddp}$, the poorer is the charging behavior of the member. The percent of photodischarge was calculated as 100 percent$\times(V_{ddp}-V_{bg})/V_{ddp}$. The light energy used to photodischarge the imaging member during the exposure step was measured with a light meter. The photosensitivity of the imaging member can be described in terms of $E_{\frac{1}{2}}$, amount of exposure energy in erg/cm$^2$ required to achieve 50 percent photodischarge from the dark development potential. The higher the photosensitivity, the smaller is the $E_{\frac{1}{2}}$ value. High photosensitivity (lower $E_{\frac{1}{2}}$ value), lower dark decay and high charging are desired for the improved performance of xerographic imaging members.

For comparison, the crude perylene (Sample I) synthesized in Example I was also evaluated by the same procedure. The xerographic results observed are summarized in Table I.

TABLE I

Results of As-synthesized Perylene and Perylene Sublimates

| Imaging Member | Perylene Sample | Sublimation Conditions | Dark Decay V/s | $E_{\frac{1}{2}}$ erg/cm$^2$ | $V_{ddp}$ Volts |
|---|---|---|---|---|---|
| 1 | Sample IIA | first fraction, from pellets | 17 | 4.7 | 800 |
| 2 | Sample IIB | second fraction, from pellets | 14 | 4.3 | 800 |
| 3 | Sample IIIA | first fraction, from powder | 62 | 5.0 | 510 |
| 4 | Sample IIIB | second fraction, from powder | 66 | 6.4 | 420 |
| 5 | Sample I | No sublimation, crude | 60 | 8 | 600 |

Perylene I sublimates (Samples IIA and IIB) obtained by subliming pelletized crude material exhibit superior electrical properties as compared to the crude (Sample I) or those (Samples IIIA and IIIB) sublimed from the crude material in powder form. Lower dark decay, higher photosensitivity (lower $E_{\frac{1}{2}}$), and higher charging (higher $V_{ddp}$) were observed for Samples IIA and IIB. They show substantial improvement in the xerographic performance over the crude and Samples IIIA and IIIB sublimates by being capable of both retaining the charge in the dark and requiring less light energy during the imaging step. Specifically, the charge retention properties, or dark decay of an imaging member with IIIA was 62, about 4 times faster than the 17 with IIA.

EXAMPLE V

Instead of performing two fractionations of sublimation as described in Example II, the process thereof was repeated with three fractionations of sublimates as follows:

In accordance with the process of Example II, 750 grams of perylene pellets were loaded into the crucible and heated to 530° C. for about 10 minutes. About 50 grams of first fraction sublimate (Sample VA) were obtained. In the second sublimation, the crucible was heated to about 540° C. for 90 minutes and 314 grams of second fraction sublimate (Sample VB) were collected. In the third sublimation, the crucible was heated to about 570° C. for 60 minutes. The third fraction sublimate (Sample VC) was collected and weighed 104 grams. The total yield of second and third fraction sublimates amounted to 55 weight percent based on the starting material in the crucible.

Perylene sublimates Samples VA, VB and VC were used to fabricate photoresponsive imaging members and xerographically tested according to the procedure in Example IV. The results of this testing are shown in Table II.

TABLE II

Results of Perylene Sublimates from an Alternate (Three Fractions) Process

| Imaging Member | Perylene Sample | Sublimation Conditions | Dark Decay V/s | $E_{\frac{1}{2}}$ erg/cm$^2$ | $V_{ddp}$ Volts |
|---|---|---|---|---|---|
| 1 | Sample VA | first fraction, from pellets | 16 | 4.6 | 800 |

TABLE II-continued

| Results of Perylene Sublimates from an Alternate (Three Fractions) Process | | | | | |
|---|---|---|---|---|---|
| Imaging Member | Perylene Sample | Sublimation Conditions | Dark Decay V/s | $E_{\frac{1}{2}}$ erg/cm$^2$ | $V_{ddp}$ Volts |
| 2 | Sample VB | second fraction, from pellets | 14 | 4.2 | 800 |
| 3 | Sample VC | third fraction, from pellets | 13 | 3.9 | 800 |

The results shown that the photosensitivity tends to improve with the number of sublimation steps. The initial fraction still contained more impurities than the latter fractions and hence exhibit a lower photosensitivity. The second and third fractions showed improvements in photosensitivity over the first fraction by 9, and 15 percent based on $E_{\frac{1}{2}}$ values.

Other modifications of the present invention will occur to those skilled in the art subsequent to a review of the present application. These modifications, and equivalents thereof are intended to be included within the scope of this invention.

What is claimed is:

1. A process for the preparation of photogenerating pigments which comprises the sublimation of a pelletized crude organic photogenerating pigment at a temperature of from about 250° to about 500° C.; depositing the sublimate in an amount of from about 0.1 to about 20 weight percent onto a first substrate; removing said first substrate and subsequently increasing the sublimation temperature by from about 10° to about 100° C. above the first sublimation temperature, depositing the resulting sublimate in an amount of from about 50 to about 80 percent onto a second substrate and removing from first and second substrate said organic photogenerating pigment.

2. A process for the preparation of photogenerating pigments which comprises the sublimation of a pelletized crude organic photogenerating pigment at a temperature of from about 250° to about 500° C.; depositing the sublimate in an amount of from about 0.1 to about 20 weight percent onto a substrate; subsequently increasing the sublimation temperature by from about 10° to about 100° C. above the first sublimation temperature, and depositing the resulting sublimate in an amount of from about 50 to about 80 weight percent onto a second substrate; allowing each substrate to cool; and removing from the first and second substrate the deposited organic photogenerating pigment.

3. A process for the preparation of photogenerating pigments, improved photoelectrical characteristics by a fractionation sublimation method which comprises the stepwise sublimation of a pelletized crude organic photogenerating pigment, and wherein the initial sublimation temperature is from about 0.1 to about 20 weight percent of the sublimate onto a substrate; subsequently increasing the sublimation temperature by from about 10° to about 100° C. above the first initial sublimation temperature for an effective period of time to enable from between about 50 to about 80 weight percent of the sublimate photogenerating pigment to be collected on a second substrate; cooling each substrate; and removing from first and second substrate the deposited organic photogenerating pigment.

4. A process in accordance with claim 3 wherein said effective period of time is from about 1 hour to about 3 hours for each kilogram of pelletized crude photogenerating pigment.

5. A process in accordance with claim 3 wherein the sublimations are accomplished in a vacuum chamber.

6. A process in accordance with claim 3 wherein the collected organic photogenerating pigment has a purity of from about 95 to about 99.9 percent.

7. A process in accordance with claim 1 wherein the crude photogenerating organic pigment is selected from the group consisting of perylenes, phthalocyanines, polycyclic quinones, polycyclic aromatic compounds, cyanines and pyrrolopyrroles.

8. A process in accordance with claim 7 wherein the crude photogenerating perylene pigment is a benzimidazole perylene comprised of a mixture of bisbenzimidazo(2,1-1:1',2'-b')anthra(2,1,9-def:6.5.10-d'e'f')diisoquinoline-6,11-dione and bisbenzimidazo(2,1-a:2',1'-a')anthra(2,1,9-def:6,5,10-de'e'f')diisoquinoline-10,21-dione.

9. A process in accordance with claim 3 wherein the sublimate organic photogenerating pigment collected is benzimidazole perylene and contains reduced amounts of metallic impurities with respect to the crude pigment.

10. A process in accordance with claim 8 wherein the initial sublimation temperature is from between about 500° and 530° C. and the second sublimation temperature is from between between about 540° and 600° C.

11. A process in accordance with claim 1 wherein the sublimations are accomplished in a vaccum chamber which is maintained under a pressure not greater than $10^{-3}$ Torr during sublimation.

12. A process in accordance with claim 3 wherein the pelletized organic photogenerating pigment is a crude benzimidazole perylene and is from about 0.1 to about 1 inch in diameter and from about 0.1 to about 1 inch in height.

13. A process in accordance with claim 3 wherein the pelletized organic photogenerating pigment is a crude benzimidazole perylene and is electrically heated during sublimation in a stainless steel crucible.

14. A process in accordance with claim 7 wherein the phthalocyanine is selected from the group consisting of chloroindium phthalocyanine, chlorogallium phthalocyanine, vanadyl phthalocyanine, and titanyl phthalocyanine.

15. A process in accordance with claim 7 wherein the polycyclic quinone is dibromoanthanthrone.

16. A process in accordance with claim 1 wherein the first substrate is stainless steel, nickel, glass, or quartz and the second substrate is stainless steel, nickel, glass, or quartz.

17. A process in accordance with claim 1 wherein subsequent to the second sublimation further sublimations are accomplished on additional substrates.

18. A process in accordance with claim 3 wherein the crude perylene pigment is is benzimidazole perylene comprised of a mixture of bisbenzimidazo(2,1-a:1',2'-b')anthra(2,1,9-def:6,5,10-d'e'f')diisoquinoline-6,11-dione and bisbenzimidazo(2,1-a:2',1'-a')anthra(2,1,9-def:6,5,10-d'e'f')diisoquinoline-10,21-dione.

19. A process in accordance with claim 3 wherein the perylene pigment product is a benzimidazole perylene comprised of a mixture of bisbenzimidazo(2,1-a:1',2'-b')anthra(2,1,9-def:6,5,10-d'e'f')diisoquinoline-6,11-dione and bisbenzimidazo(2,1-a:2',1'-a')anthra(2,1,9-def:6,5,10-d'e'f')diisoquinoline-10,21-dione.

20. A process in accordance with claim 1 wherein the crude photogenerating pigment is benzimidazole perylene comprised of a mixture of bizbenzimidazo)2,1-a:1'2'-b')anthra(2,1,9-def:6,5,10-d'e'f')diisoquinoline-6,11-dione and bisbenzimidazo(2,1-a:2',1'-a')anthra(2,1,9-def:6,5,10-d'e'f')diisoquinoline-10,21-dione.

21. A process in accordance with claim 17 wherein up to 5 sublimations are accomplished on 5 different substrates and wherein there is removed from each substrate the formed organic photogenerating pigment.

* * * * *